US007111633B2

(12) United States Patent
Moroney

(10) Patent No.: US 7,111,633 B2
(45) Date of Patent: Sep. 26, 2006

(54) PIPELINE WELDING SHELTER AND METHOD OF USE OF THE SAME

(75) Inventor: Christopher Mark Moroney, Cold Lake (CA)

(73) Assignee: C-Mark Welding Ltd., Cold Lake (CA)

( * ) Notice: Subject to any disclaimer, the term of this patent is extended or adjusted under 35 U.S.C. 154(b) by 0 days.

(21) Appl. No.: 10/446,617

(22) Filed: May 28, 2003

(65) Prior Publication Data

US 2004/0011394 A1 Jan. 22, 2004

(30) Foreign Application Priority Data

May 29, 2002 (CA) ..... 2388112

(51) Int. Cl.
*A45B 3/00* (2006.01)

(52) U.S. Cl. ..... 135/98; 135/16; 135/19; 135/132; 52/79.1

(58) Field of Classification Search ..... 52/79.1, 52/79.4, 82; 135/16, 19, 98, 106, 900, 132, 135/135, 159, 160; 248/219.4, 222.4, 218.4, 248/219.2

See application file for complete search history.

(56) References Cited

U.S. PATENT DOCUMENTS 499,240 A * 6/1893 Mann ..... 135/98
560,245 A 5/1896 Wagner
988,400 A 4/1911 Stonebridge
1,219,905 A 3/1917 Barringer
1,268,767 A 6/1918 Peak
3,040,478 A * 6/1962 Ferguson ..... 52/73
3,765,434 A * 10/1973 Riggs ..... 135/20.1
5,135,018 A 8/1992 Anderson ..... 135/99
5,287,872 A * 2/1994 Anderson ..... 135/98
5,390,685 A * 2/1995 McCoy ..... 135/19
5,502,848 A * 4/1996 Cowan ..... 4/619
D370,336 S * 6/1996 Rosier ..... D3/5
5,727,583 A * 3/1998 Kennedy ..... 135/20.1
5,836,327 A * 11/1998 Davis ..... 135/16
5,850,843 A * 12/1998 Mahood et al. ..... 135/88.06
5,878,763 A * 3/1999 Tsai ..... 135/25.33

* cited by examiner

*Primary Examiner*—Basil Katcheves
(74) *Attorney, Agent, or Firm*—Davis & Bujold, P.L.L.C.

(57) ABSTRACT

A pipeline welding shelter which includes an umbrella-like framework with a support post which supports the umbrella-like framework. Means is provided for maintaining the support post in a substantially vertical orientation when positioned on or adjacent to a pipeline. A flexible heat resistant covering encloses the umbrella-like framework. The covering is capable of withstanding limited exposure to heat from a welding torch without melting or igniting.

4 Claims, 8 Drawing Sheets

PIPELINE WELDING SHELTER AND METHOD OF USE OF THE SAME

FIELD OF THE INVENTION

The present invention relates to a pipeline welding shelter and a method of using the pipeline welding shelter.

BACKGROUND OF THE INVENTION

Welding on pipelines is performed within shelters. The shelters prevent weld quality from being adversely affected by moisture, dust or air movement. Existing welding shelters are metal structures which weight approximately 1000 pounds. The shelters are moved from place to place by transport vehicles. Once on site, the shelters are lifted into position and moved along the pipeline right away by mechanized lifting apparatus. Care must be taken when operating near any overhead power lines to lift the power lines or take other measures to ensure that there is adequate clearance for the handling of the shelters. Safety issues also arise when hooking and unhooking the shelters from the lifting apparatus, as the attachment points are 12 to 14 feet above the ground. Three to four men crews are used to move the shelters. There is frequently lost production as welders wait for the shelters to be moved into place.

SUMMARY OF THE INVENTION

What is required is a pipeline welding shelter and a method of use of the same.

According to the present invention there is provided a pipeline welding shelter which includes an umbrella-like framework with a support post which supports the umbrella-like framework. Means is provided for maintaining the support post in a substantially vertical orientation when positioned on or adjacent to a pipeline. A flexible heat resistant covering encloses the umbrella-like framework. The covering is capable of withstanding limited exposure to heat from a welding torch without melting or igniting.

The pipeline welding shelter, as described above, represents a marked departure from what has been used to date by welders servicing the pipeline industry. One great advantage it provides is its portability. It can readily be manually transported down a pipeline right of way, rapidly erected and rapidly taken down by two men. This enables the welders to handle the pipeline welding shelter themselves, without waiting as was previously the case.

Although beneficial results may be obtained through the use of the pipeline welding shelter, as described above, there are several other features which can be added to further improve its functioning.

Even more beneficial results may be obtained when a plurality of rigid vertical supports are positioned at intervals around a perimeter of and depend from the umbrella-like framework. The use of such vertical supports limits inward movement of the covering in response to pressure exerted by wind.

Even more beneficial results when the plurality of rigid vertical supports can be detached from the umbrella-like framework and can be inserted into the hollow tubular arms for storage when not in use. The ability to store the vertical supports in the hollow tubular arms of the umbrella-like framework enhances portability.

Even more beneficial results may be obtained when the means for maintaining the support post in a vertical position is a saddle securable to the pipeline. The support post has a first end and a second end. The first end engages the umbrella-like framework. The second end is engaged by a receiver in the saddle.

Even more beneficial results may be obtained when the receiver is pivotally mounted to the saddle for pivotal movement about a substantially horizontal pivot axis. This enables the second end of the support post to be inserted into the receiver, when the receiver is in a substantially horizontal orientation. The receiver and support post can then be pivoted to a substantially vertical orientation. Means is provided to lock the receiver in the substantially vertical orientation.

Even more beneficial results may be obtained when the support post has an intermediate portion which is in an angular orientation to at least one of the first end and the second end. This feature enables the saddle to be spaced from the welding area, while maintaining the shelter directly over the welding area.

Even more beneficial results may be obtained when the support post rotates within the receiver. When combined with the angular intermediate portion, this feature enables the shelter to be moved to cover areas on either side of the saddle without having to move the saddle. This is done by selectively rotating the post so that the angular intermediate portion extends to the left or the right of saddle. Means being provided to lock the support post in the selected rotational position.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
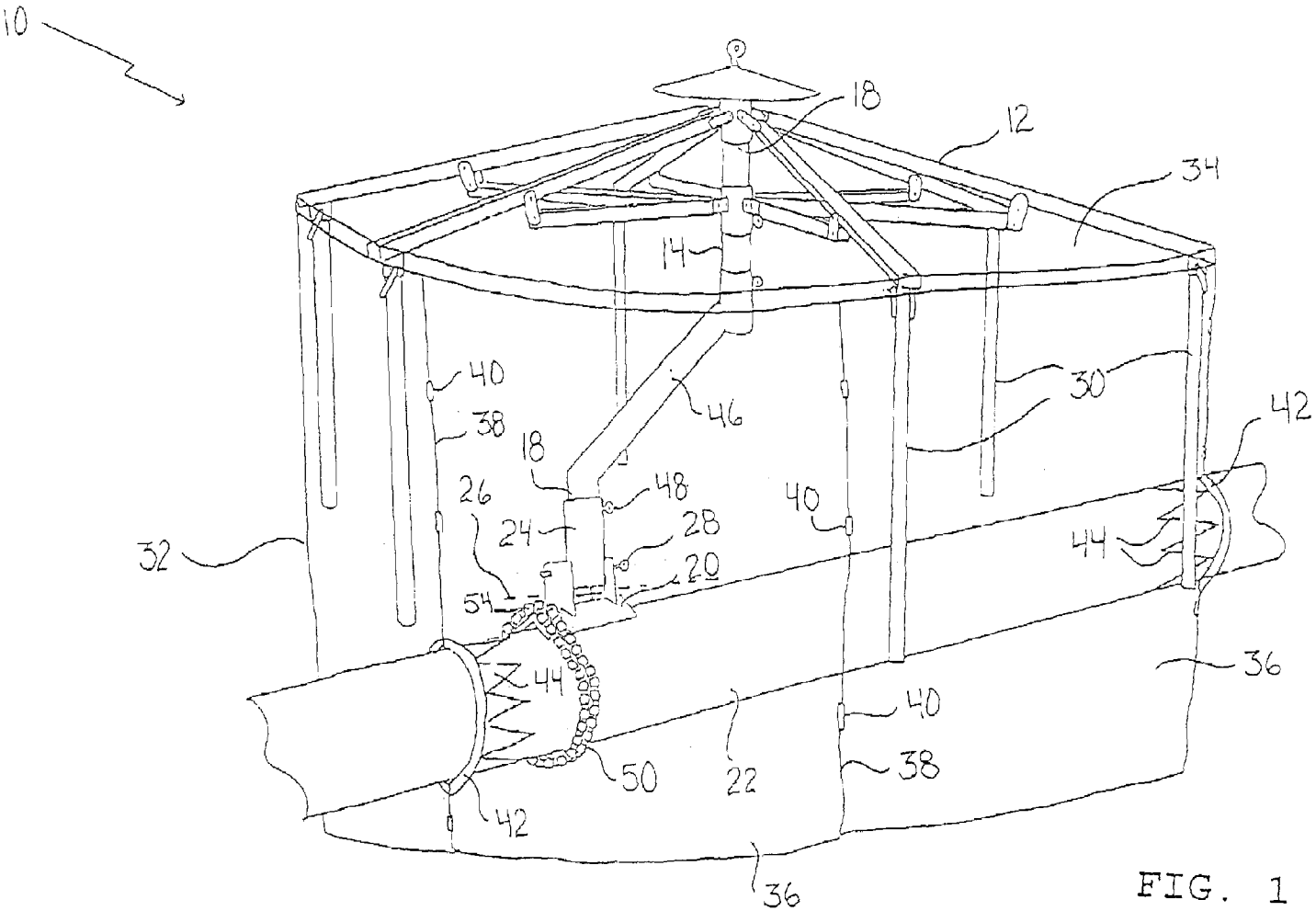
FIG. 1 is a side elevation view, in section, of a pipeline welding shelter constructed in accordance with the teachings of the present invention.

The preferred embodiment, a pipeline welding shelter generally identified by reference numeral 10, will now be described with reference to FIGS. 1 through 8.

Figure 2:
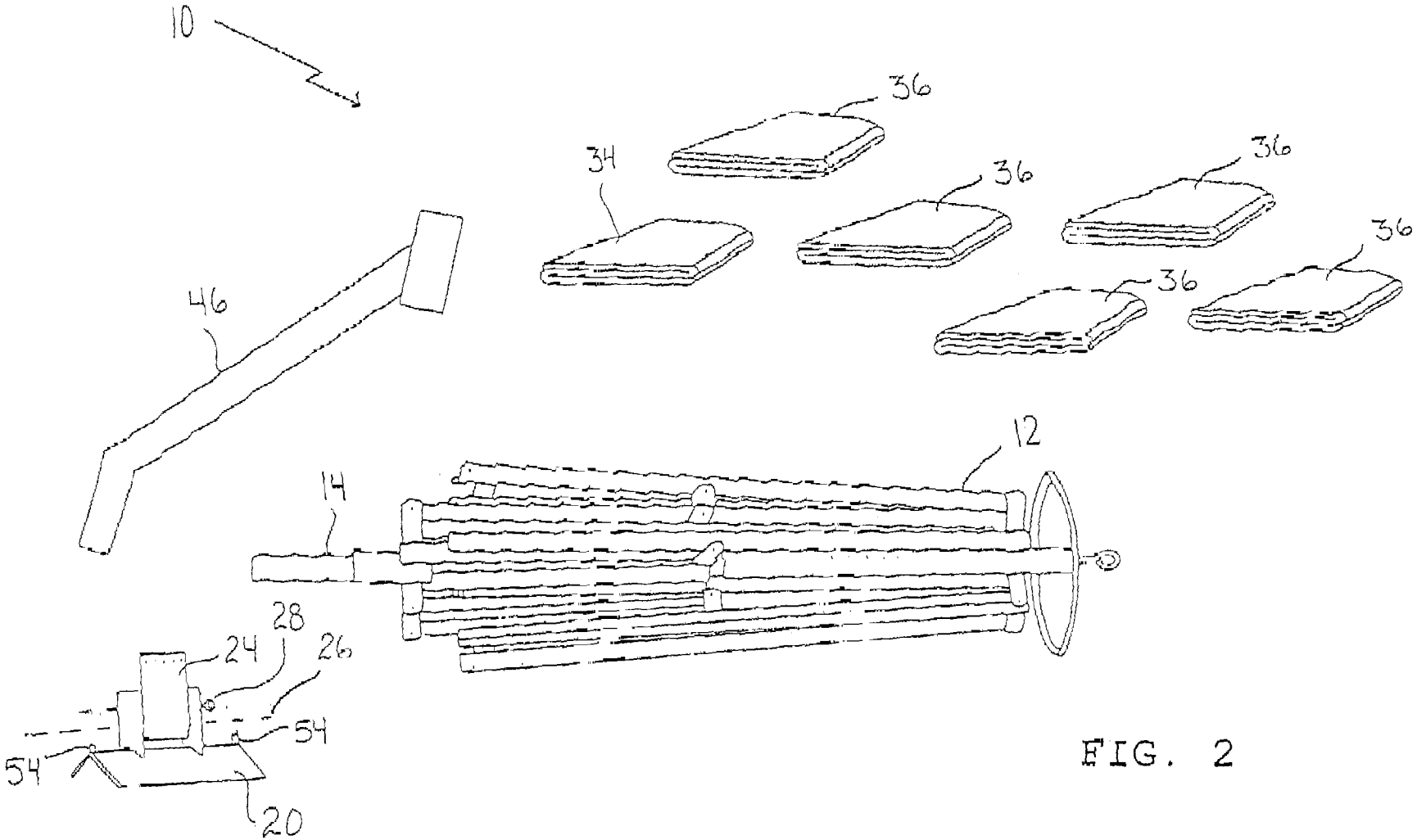
FIG. 2 is an exploded side elevation view of the components of the pipeline welding shelter illustrated in FIG. 1, with pipeline welding shelter collapsed and ready for transport.

Structure and Relationship of Parts:

Referring to FIG. 1, pipeline welding shelter 10 includes an umbrella-like framework 12 with a support post 14 which has a first end 16 and a second end 18. Umbrella-like framework 12 has a plurality of radially extending hollow tubular arms 19. First end 16 of support post 14 engages umbrella-like framework 12. Referring to FIG. 2, a saddle 20 is provided that is adapted to be secured to a pipeline 22. Saddle 20 has a receiver 24 that receives second end 18 of support post 14. Receiver 24 is pivotally mounted to saddle 20 for pivotal movement about a substantially horizontal pivot axis 26. Referring to FIG. 1, a locking pin 28 is provided to lock receiver 24 in a substantially vertical orientation, thereby maintaining support post 14 in a substantially vertical orientation when saddle 20 is positioned on pipeline 22.

Figure 6:
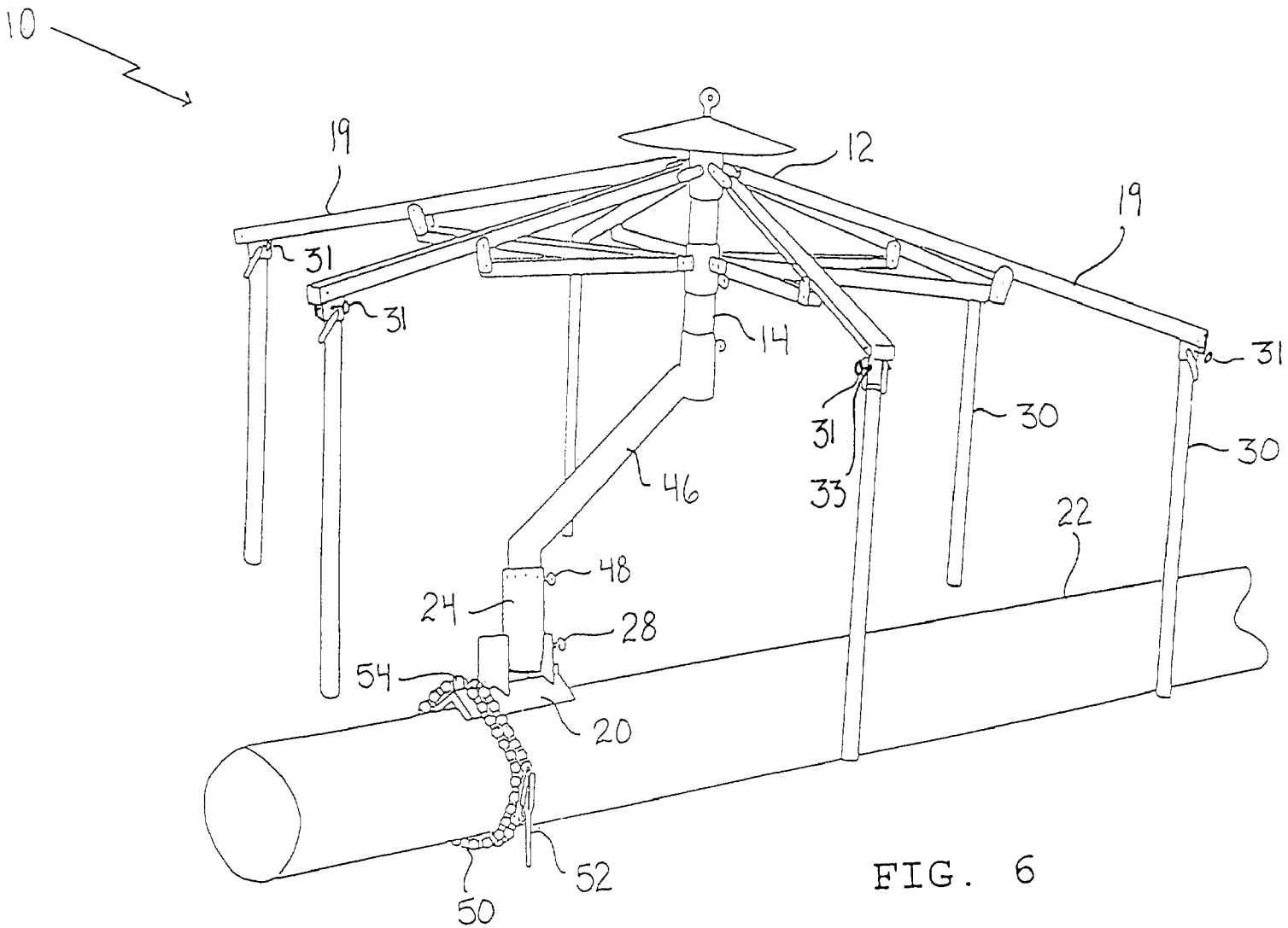
FIG. 6 is a side elevation view, in section, of the pipeline welding shelter illustrated in FIG. 1, with the angular intermediate portion of the support post rotated to the left side of the saddle.
Figure 7:
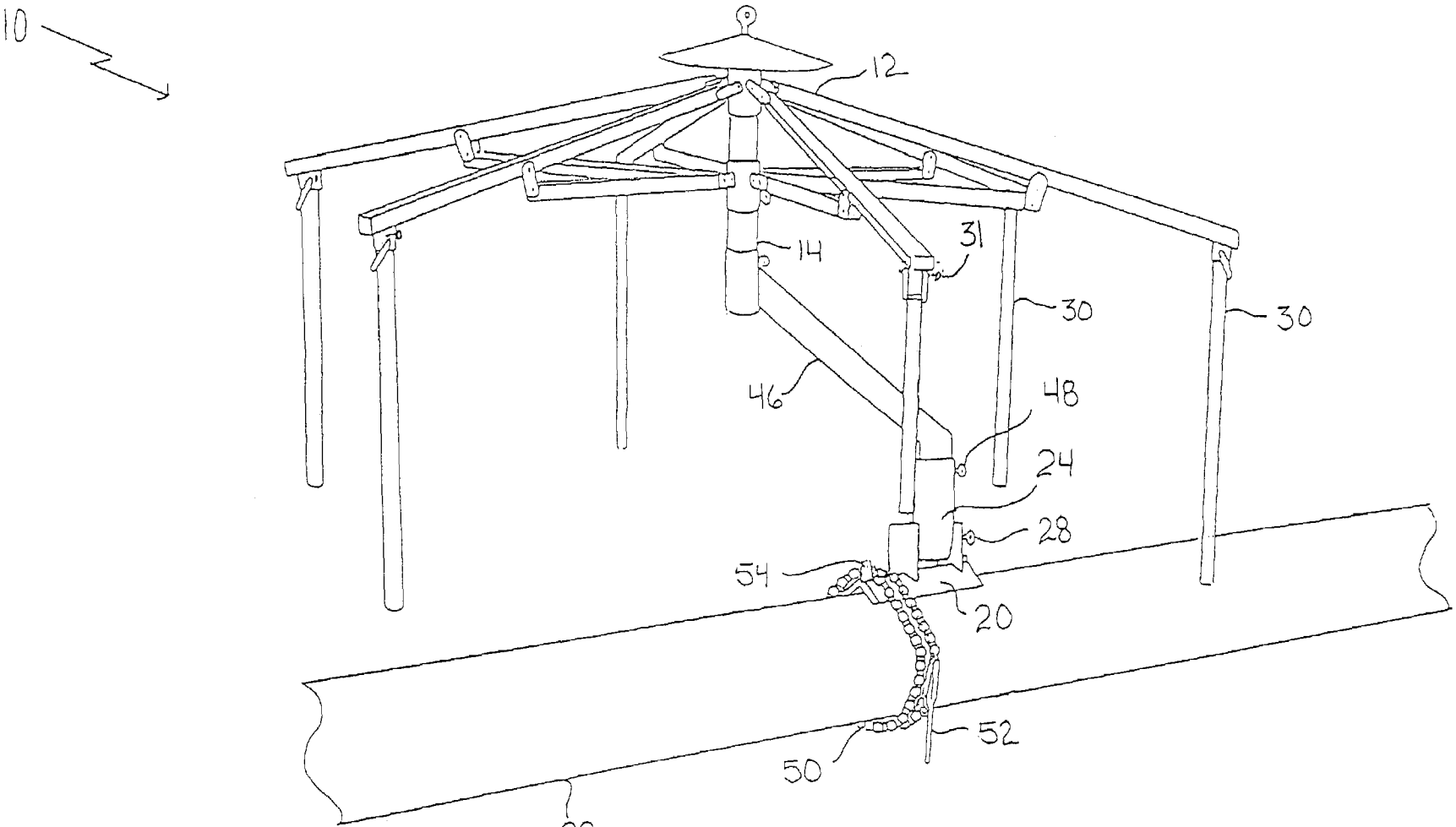
FIG. 7 is a side elevation view, in section, of the pipeline welding shelter illustrated in FIG. 1, with the angular intermediate portion of the support post rotated to the right side of the saddle.

Referring to FIGS. 6 and 7, a plurality of rigid vertical supports 30 are positioned at intervals around a perimeter of and depending from hollow tubular arms 19 of umbrella-like framework 12. Referring to FIG. 6, a pin 31 is inserted into a first pin receiving aperture 33 in each hollow tubular arm 19 to lock vertical supports 30 in position when depending from hollow tubular arms 19.

Figure 5:
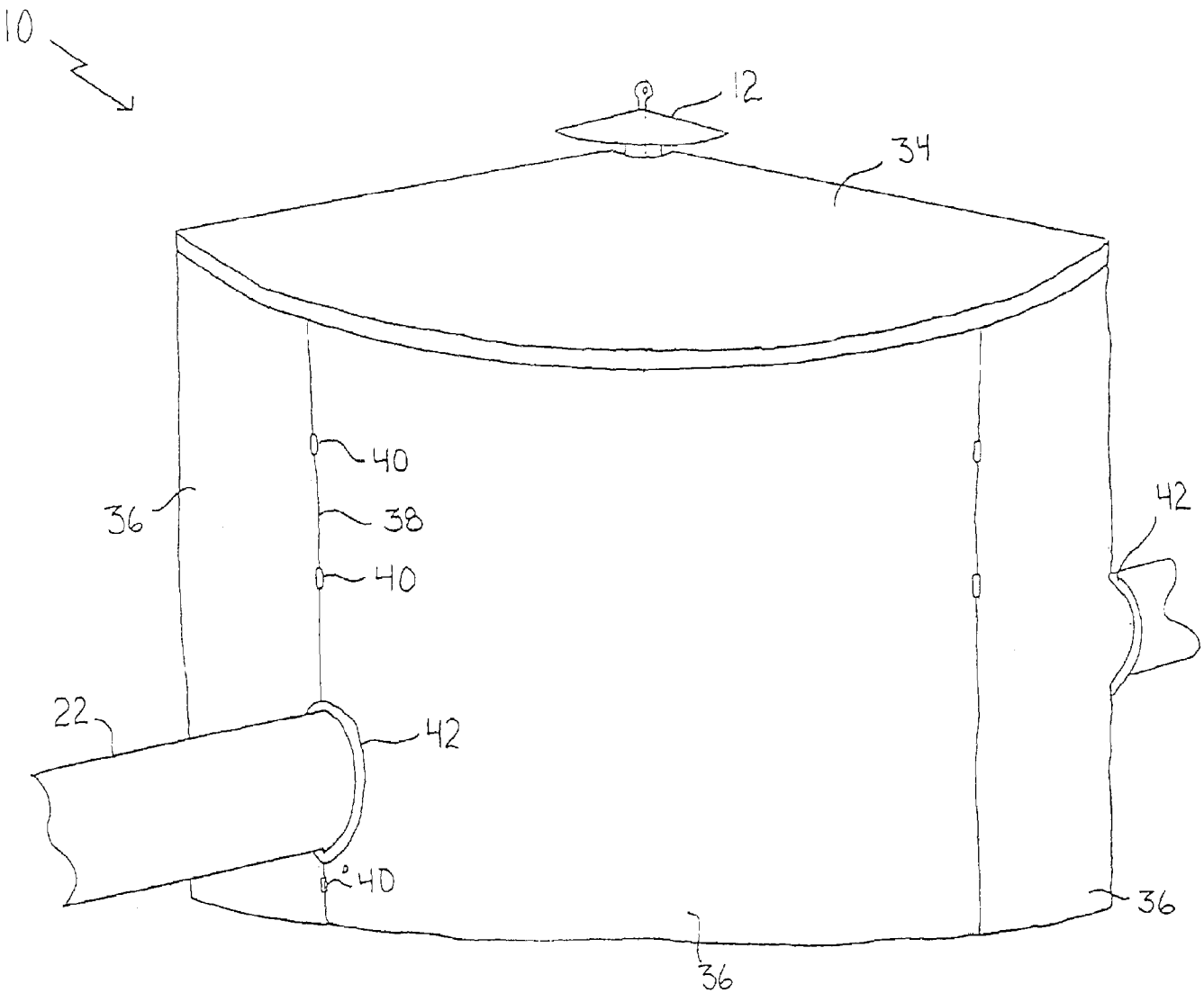
FIG. 5 is a side elevation view of the pipeline welding shelter illustrated in FIG. 1, with the receiver and support post raised to the vertical position and the pipeline enclosed by the covering.

Referring to FIG. 5, a flexible heat resistant covering 32 encloses umbrella-like framework 12. Covering 32 is capable of withstanding limited exposure to heat from a welding torch without melting or igniting. Referring to FIG. 1, vertical supports 30 limit inward movement of covering 32 in response to pressure exerted by wind. In the illustrated embodiment, covering 32 includes a roof 34 and several vertical panels 36. Hollow tubular arms 19 of umbrella-like framework 12 support roof 34. Vertical panels 36 extend downward from roof 34 and are joined together along vertical seams 38 by buckles 40. Two openings 42 are provided in vertical seams 38 of covering 32 which are adapted to accommodate pipeline 22 which passes through pipe welding shelter 10. In the illustrated embodiment, openings 42 have flexible flaps 44, which allow for pipelines 22 of varying diameters to pass through covering 32.

Support post 14 has an intermediate portion 46 that is positioned between first end 16 and second end 18. Intermediate portion 46 is in an angular orientation in relation to both first end 16 and second end 18 of support post 14. Support post 14 is able to rotate. A locking pin 48 is provided to lock support post 14 in a selected rotational position.

Operation:

The use and operation of pipeline shelter will now be described with reference to FIGS. 1 through 8. Referring to FIG. 5, there is provided a method of protecting an area of a pipeline 22 to be welded from atmospheric contaminants by providing pipeline welding shelter 10, as described above.

Referring to FIG. 2, pipeline welding shelter 10 is easily portable as umbrella-like framework 12 can be transported in the collapsed position whereby hollow tubular arms 19 are folded down against support post 14. Panels 36 and roof 34 of covering 32 can be separated and folded as illustrated in FIG. 2, thereby adding to the portability of pipeline welding shelter 10.

Figure 3:
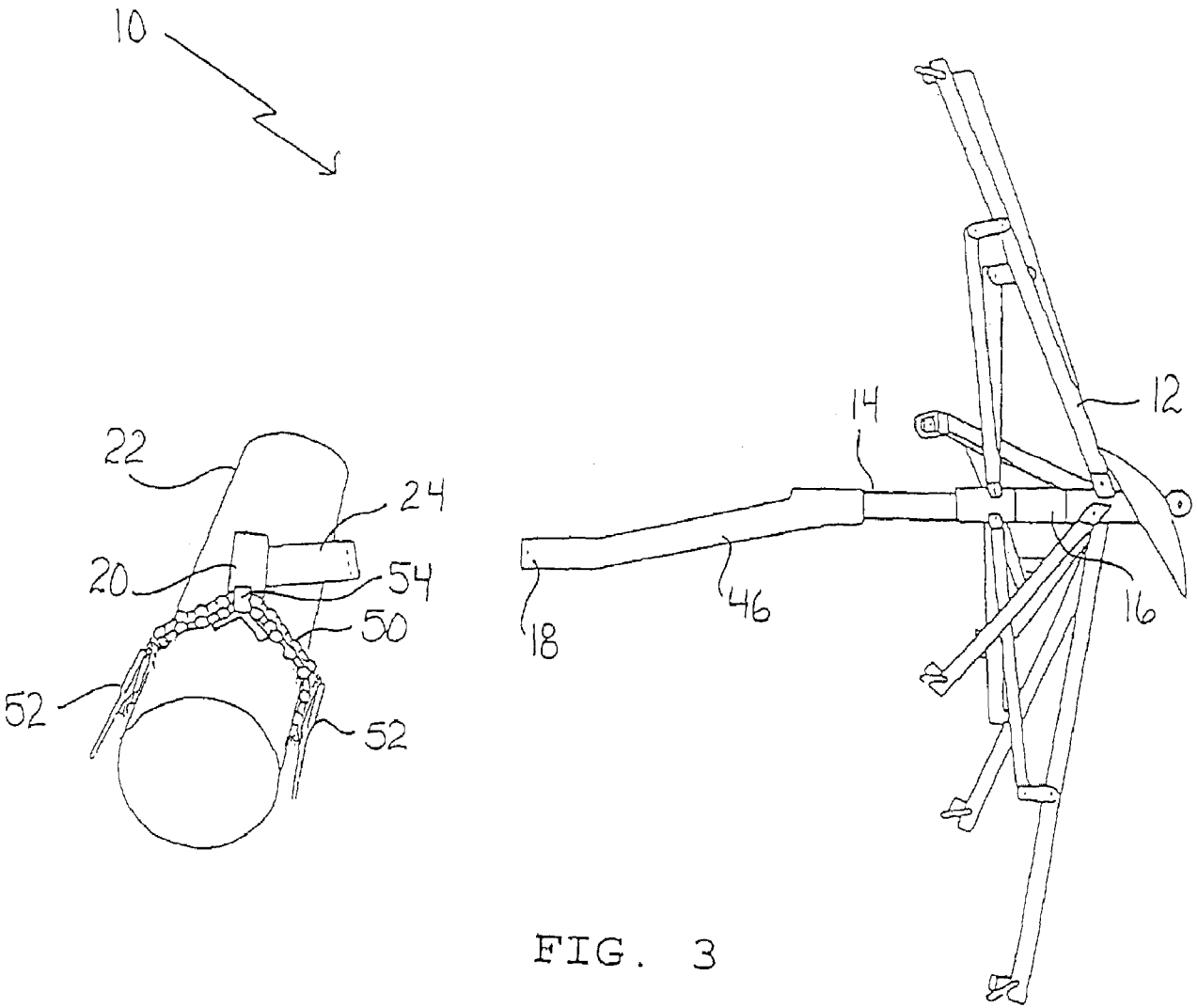
FIG. 3 is a side elevation view of the pipeline welding shelter illustrated in FIG. 1, in the process of installing the saddle on the pipeline and mating the support for the umbrella-like framework with the receiver on the saddle.

Referring to FIG. 5, once pipeline welding shelter 10 has been transported to pipeline 22, pipeline welding shelter 10 is then assembled and erected with pipeline 22 extending through pipeline welding shelter 10. Referring to FIG. 3, in order to erect pipeline welding shelter 10, saddle 20 is secured to pipeline 22. In the illustrated embodiment, a chain 50 is wrapped twice around pipeline 22 and saddle 20 to secure saddle 20 in place on pipeline 22. Chain boomers 52 are used to adjust the tension of chains 50. Stops 54 are provide on saddle 20 to prevent chains 50 from slipping off. Although chains 50 with chain boomers 52 are shown in the illustrated embodiment, it will be appreciated that other methods can be used to secure saddle 20 to pipeline 22.

Figure 4:
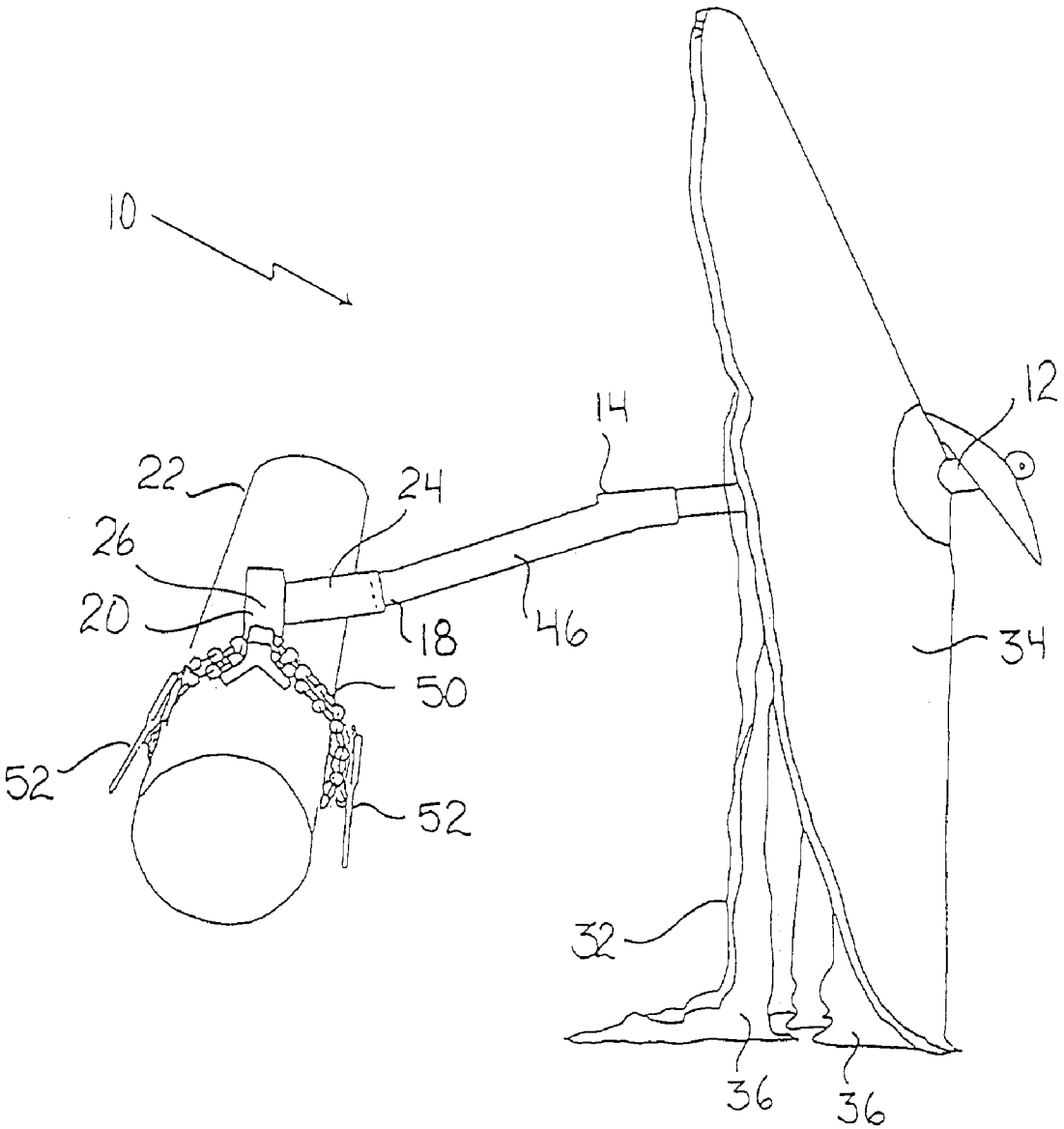
FIG. 4 is a side elevation view of the pipeline welding shelter illustrated in FIG. 1, in the process of installing the covering onto the umbrella-like framework.

Referring to FIGS. 2 and 3, umbrella-like framework 12 that is collapsed during storage or transportation as illustrated in FIG. 2, is opened up as illustrated in FIG. 3. Referring to FIG. 4, covering 32 is placed over umbrella-like framework 12. Second end 18 of support post 14 is inserted into receiver 24 when receiver 24 is in a substantially horizontal orientation. Referring to FIG. 1, receiver 24 and support post 14 can then be pivoted to a substantially vertical orientation and locked with locking pin 28 to maintain support post 14 and umbrella-like framework 12 in substantially vertical orientation.

Referring to FIG. 1, when support post 14 is secured in a substantially vertical orientation, intermediate portion 46 of support post 14 can be rotated to a selected rotational position and secured in selected rotational position by locking pin 48. Panels 36 of covering 32 can be arranged so that openings 42 along seams 38 of cover 32 are placed around the diameter of pipeline 22. Flaps 44 in openings 42 allow for pipeline 22 to pass through openings 42, yet operate to prevent environmental contaminants from entering pipe welding shelter 10 through openings 42. Panels 36 of covering 32 are secured along seams 38 by buckles 40 above and below openings 42. Plurality of rigid vertical supports 30 that are positioned at intervals around a perimeter of and depending from hollow tubular arms 19 of umbrella-like framework 12, limit inward movement of covering 32 in response to pressure exerted by wind.

Figure 8:
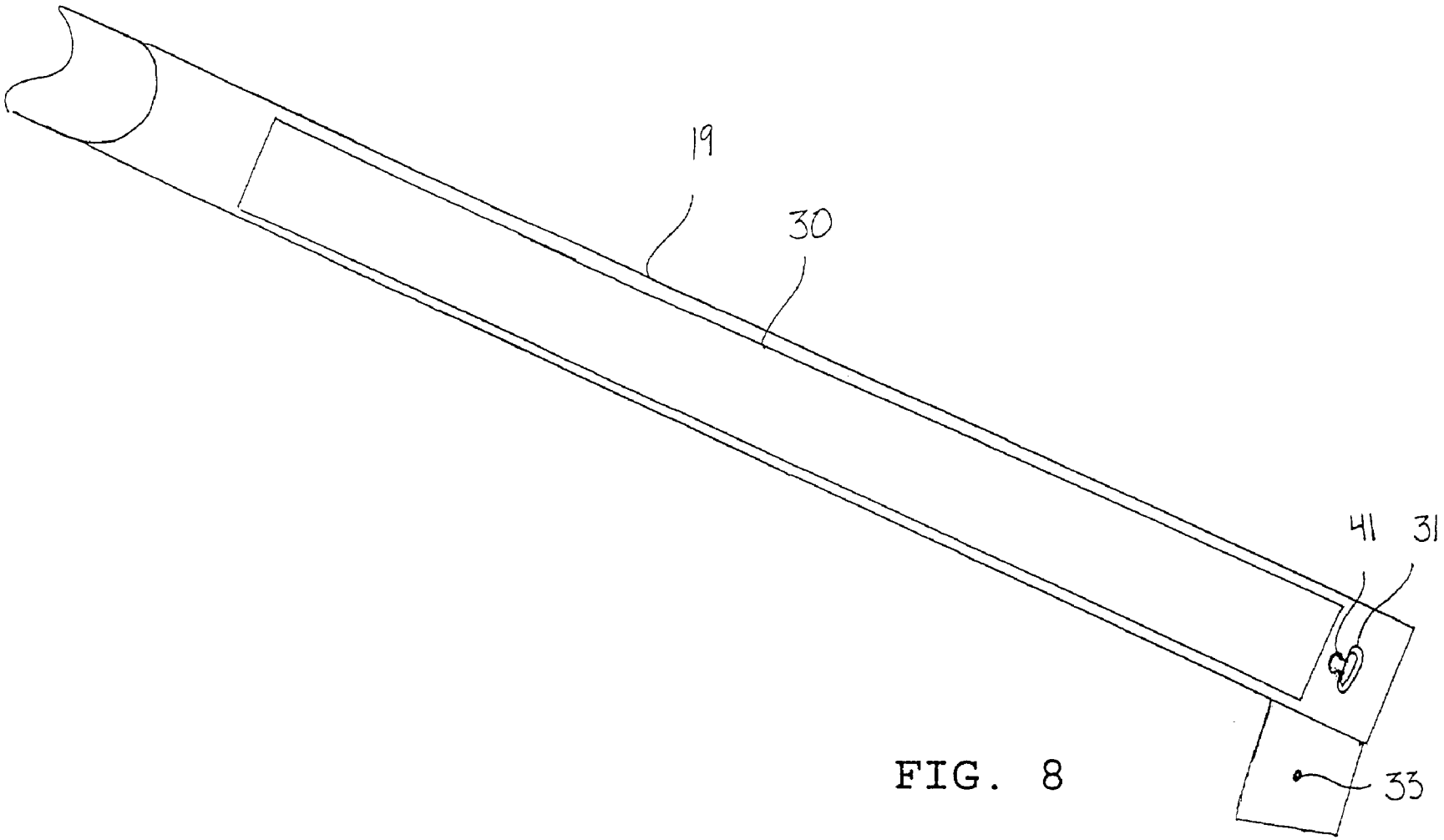
FIG. 8 is a detailed side elevation view, in section, of the pipe welding shelter illustrated in FIG. 1 with the vertical support post positioned inside of the hollow tubular arm of the umbrella-like framework.

Referring to FIG. 8, if vertical supports 30 are not required, then pin 31 is removed from first pin receiving aperture 33 to detach vertical support 30 from tubular arm 10. Vertical support 30 can then be inserted inside of hollow tubular arms 19 for storage, and pin 31 can be inserted into a second pin receiving aperture 41 in hollow tubular arm 19 to prevent vertical supports 30-from sliding out of hollow tubular arms 19 during storage. Vertical supports 30 can also be stored in this manner when umbrella-like framework 12 is collapsed for transportation as illustrated in FIG. 2

Referring to FIG. 5, once pipe welding shelter 10 has been erected, it is suitable for use by workers to protect them during welding operations on pipeline 22.

Referring to FIG. 6, as work progresses, and pipe welding shelter 10 needs to be repositioned, the angular orientation of intermediate portion 46 allows for rapid repositioning of umbrella-like framework 12 without having to reposition saddle 20. To do so, locking pin 48 is removed from intermediate portion 46 of support post 14 to allow support post 14 to be rotated to a new selected rotational position as illustrated in FIG. 7. Once repositioned, locking pin 48 is used to secure support post 14 in new selected rotation position. Referring to FIG. 1, as panels 36 are secured along seams 38 by buckles 40, buckles 40 can easily be undone to free pipeline 22 from openings 42 during repositioning of pipe welding shelter 10. Saddle 20 does not need to be removed during repositioning.

In this patent document, the word "comprising" is used in its non-limiting sense to mean that items following the word are included, but items not specifically mentioned are not excluded A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The invention claimed is:

1. A pipeline welding shelter, comprising:

an umbrella-like framework;

a support post having a first end and a second end, the first end engaging the umbrella-like framework;

an elongated saddle for maintaining the support post in a substantially vertical orientation when positioned on a pipeline, the saddle being adapted to rest lengthwise upon a horizontal section of the pipeline, the saddle having a concave underlying engagement surface that fits a curvature of the pipeline and a receiver that receives the second end of the support post, the receiver being pivotally mounted to the saddle for pivotal movement about a substantially horizontal pivot axis, means being provided to lock the receiver in a substantially vertical orientation, thereby maintaining the support post in a substantially vertical orientation when the saddle is positioned on the pipeline;

chains wrapped around the saddle and boomers for placing the chains in tension to secure the saddle to the pipeline;

a flexible heat resistant covering enclosing the umbrella-like framework, the covering being capable of withstanding limited exposure to heat from a welding torch without melting or igniting; and a plurality of rigid vertical supports positioned at intervals around a perimeter of and depending from the umbrella-like framework, the vertical supports limiting inward movement of the covering in response to pressure exerted by wind.

2. The pipeline welding shelter as defined in claim 1, wherein the support post has an intermediate portion positioned between the first end and the second end, the angular portion being in an angular orientation to at least one of the first end and the second end.

3. The pipeline welding shelter as defined in claim 2, wherein the support post rotates, means being provided to lock the support post in a selected rotational position. substantially horizontal pivot axis, means being provided to lock the receiver in a substantially vertical orientation, such that the support post is inserted into the receiver when the receiver is in a substantially horizontal orientation then the receiver and support post are pivoted to a substantially horizontal orientation and locked to maintain the substantially horizontal orientation.

4. A pipeline welding shelter, comprising:

a framework;

at least one support post supporting the framework, the at least one support post having a first end and a second end, the first end engaging the framework;

at least one elongated saddle securable to the pipeline maintaining the at least one support post in a substantially vertical orientation, the at least one saddle being adapted to rest lengthwise upon a horizontal section of the pipeline and having a concave underlying engagement surface that fits a curvature of the pipeline and a receiver that engages the second end of the at least one support post;

chains wrapped around the saddle and boomers for placing the chains in tension to secure the saddle to the pipeline; and a flexible heat resistant covering enclosing the framework, the covering being capable of withstanding limited exposure to heat from a welding torch without melting or igniting.

* * * * *